US005224559A

United States Patent [19]

Arnoldy

[11] Patent Number: 5,224,559

[45] Date of Patent: Jul. 6, 1993

[54] HARDFACED DRILLING TOOL JOINTS

[75] Inventor: Roman F. Arnoldy, Houston, Tex.

[73] Assignee: Arnco Technology Trust, Houston, Tex.

[21] Appl. No.: 695,278

[22] Filed: May 3, 1991

[51] Int. Cl.[5] ..... C22B 38/04; E21C 13/00

[52] U.S. Cl. ..... 175/374; 285/333

[58] Field of Search ..... 175/320, 325, 374, 409, 175/411; 285/333

[56] References Cited

U.S. PATENT DOCUMENTS 3,402,459 9/1968 Arnoldy ..... 148/4

3,494,749 2/1970 Arnoldy ..... 428/686 X 3,989,554 11/1976 Wisler ..... 175/374 X

*Primary Examiner*—William P. Neuder

*Attorney, Agent, or Firm*—James F. Weiler

[57] ABSTRACT

Disclosed are methods of hardfacing and hardfaced tool joints used for connecting together drilling pipe for drilling bore holes in the earth, such as drilling to possible oil and gas formations. The hardfacing is welded to the outer surface of the box member of the tool joint and forms a surface harder than silicious earth particles but a surface which does not cut casing through which the drilling pipe and tool joints move. Hardfacing alloys having the foregoing properties contain primary carbides in a matrix which are present in an amount to form a plurality of cracks of not less than one in 3 inches on cooling from molten to solid state are satisfactory. Such cracking causes no damage to the box member, provides an indication of the primary carbides present and hence the abrasion resistance of the hardfacing and provides a long wearing service life for the box member.

13 Claims, 2 Drawing Sheets

HARDFACED DRILLING TOOL JOINTS

FIELD OF THE INVENTION

The present invention is in the field of improving the service life of tool joints connecting drilling pipe together when used in earth boring and passing through casing to improve service life of the tool joints while minimizing damage to the well casing.

BACKGROUND OF THE INVENTION

In drilling for oil and gas, a drilling string of pipe secured together by tool joints having drill collars at its lower end to which a bit is connected is rotated from the surface of the ground to drill a bore hole in the earth to the formation or formations from which oil or gas or both are to be produced. During the course of the drilling operations, a casing having an inside diameter large enough for passage of the drilling string, tool joints, drill collars and bit is secured in place, normally by cementing, to hold the earth formations in place and prevent them from collapsing onto the drilling string and drill collars, and to prevent fluid circulated through the drill string, the drill collar and bit and circulated with earth boring up the annulus between the drill collars, and drill string and the earth and casing to enter the earth formations and to prevent fluid from the formations to flow into the bore hole.

There has been a severe problem with service life of the tool joints since approximately 95 percent of the surface of the earth is composed of silicious materials which are very abrasive and which cause considerable wear on the tool joints, particularly the box member of the tool joint while the drill's string is being rotated thereby rubbing the enlarged box portion against the earth and thus shortening the life of the tool joint.

There have been numerous attempts to provide hardfacing on the box member of the tool joint. For a description of prior art hardfacing for tool joints, reference is made to U.S. Pat. No. 4,256,518, the composite catalog of oil field equipment and services, 1976/77 edition, at pages 3216–19 and pages 4994–5; U.S. Pat. No. 3,067,593. Also, for the use of hardfacing materials, such as tungsten carbide particles to form a hardened surface at a tool joint to increase wear resistance, reference is made to U.S. Pat. No. 3,989,554 issued Nov. 2, 1976 and then the history of oil well drilling by J. E. Brantly published in 1971 by the book division of Gulf Publishing Company, Houston, Texas. Also, reference is made to U.S. Pat. Nos. 2,259,232; 2,262,211; 4,431,902; and 4,942,059 which illustrates various prior art ways to hardface tool joints.

Historically, and in practice, tool joints on drilling pipe such as used in drilling oil and gas wells have been faced at the bottom of the box end with tungsten carbide to resist the abrasion of the rock earth in the drill hole on the tool joint. This has three disadvantages. Tungsten carbide is expensive, it acts as a cutting tool to cut the well casing in which it runs, and the matrix is a soft steel which erodes away easily to allow the carbide particles to fall away.

In most industries, the metal components which make up the structure and equipment of a given plant must have integrity, which means being free of any kind of cracks since these might be expected to progress through the piece and destroy the part.

When the loss of human life may be involved or when great property damage may result, the requirements for integrity are particularly strict. Examples are pressure vessels in the process industries, structural members in buildings and bridges and down hole drilling equipment in the oil and gas industry.

Hardfacing materials harder than silicious earth materials are brittle and crack. In the 50 year history of hardfacing tool joints of drilling pipe, no facing which cracked has been used in practice prior to the development of the present invention.

It would be highly desirable to provide hardfaced drilling tool joints and methods of hardfacing such tool joints which provide a surface harder than silicious earth particles, and although it cracks is satisfactory for use on tool joints providing longer wear life than at present and at the same time does not damage or cut the casing in the well bore.

SUMMARY OF THE INVENTION

Silicious earth particles have a hardness of about 800 Brinell hardness number (bhn). In the present invention hardfacing material is used which contains primary carbides which have a hardness of about 1700 bhn in a matrix having a hardness of at least 300 bhn and preferably about 400 to 600 bhn. The primary carbides at this high hardness have little tensile strength and hence pull apart on cooling from molten state at a frequency that depends on the relative quantity of primary carbides in the mix of metal and carbides. For this reason, the frequency of cracking is a measure of the quantity of primary carbides present which forms a measure of the relative abrasion resistance of a facing in a silicious environment.

Hardfacing material harder than silicious earth materials which when applied by deposition welding or with bulk welding forms shrinkage cracks across the weld bead with a frequency of not less than one in about 3 inches and, preferably, about ½ inch to 1 inch apart is satisfactory. At this frequency the hardfacing has the abrasion resistance to withstand silicious earth particles, and the stress in the root of each crack will not be enough to cause progression into the base metal and destruction of the part faced, that is, the box member. For example, a piece of metal with a single saw cut through ⅞ of its thickness will either bend or break when bending pressure is applied. If a multiplicity of saw cuts are made to the same depth in the same size piece, the piece will flex into a bow without breaking when bending or pressure is applied. Thus, a long length of facing upon shrinking from a molten state will accumulate greater yield point stresses than in a single cut; however, in the case of multiple cuts, comparable to frequent cracks in a facing, the shrinkage stress is divided up into small elements of length and the stress in the root of each crack is so low as to cause no further cracking when flexed.

Accordingly, the present invention is directed to a tool joint for connecting together drill pipe having an internally threaded box for reception of a threaded pin member, the box having a cylindrical outer surface with an outer diameter greater than the drill pipe's outer surface and includes a layer of hardfacing material containing primary carbide harder than silicious earth materials welded to the outer cylindrical surface, the layer of hardfacing material having the property that on shrinkage from molten state of plurality of cracks is formed extending through the hard surface generally normal to the cylindrical surface in a generally random and nonlinear pattern of a frequency of not less than about 1 in each 3 inches, and preferably from about ½ inch to 1 inch apart.

Preferably, the hardfacing material comprises high chrome iron of from about 20 to about 30 percent chromium, about 3.5 to about 5 percent carbon, and which when deposition welded or bulk welded to the box forms primary carbides of a hardness of about 1700 bhn and a metal matrix of at least 300 to about 400 to 600 bhn. Examples of other suitable hardfacing materials are set forth subsequently.

The hardfacing material may be either applied on the surface of the outer cylindrical portion of the box member or the outer surface may be recessed so that the hard surfacing material is substantially flush with the outer cylindrical surface of the box member. Also, the pin member may be hardfaced but the usual practice is not to do so.

The method of the invention comprises deposition welding or bulk welding of the hardfacing material to the outer cylindrical surface of the box member and upon shrinkage from a molten condition forming cracks across the weld bead of not more than about 3 inches apart and, preferably, about ½ inch to 1 inch apart.

It is an object of the present invention to improve the service life of tool joints connecting drilling pipe together used in earth boring and which will not damage casing disposed in the earth bore through which the tool joints pass.

It is a further object of the present invention to hardface the box member of tool joints connecting drilling pipe together with hardfacing material that can withstand wear of rubbing against the silicious formations of the earth and which do not cut casing in the bore hole.

It is a further object of the present invention to improve the service life of tool joints by welding an abrasion wear resistant surface on the box member of the tool joint with hardfacing material which forms shrinkage cracks of not less than 1 in 3 inches and which withstand abrasion of silicious earth materials and which will not cut the casing through which the tool joints pass.

A further object of the present invention is to provide a method of prolonging the service life of such tool joints by welding or bulk welding on a box of the tool joint a hardfacing material having a composition of from about 20 percent to about 30 percent chromium, about 3.5 to 5 percent carbon and balance iron which form primary carbides of $(FeCr)_7C_3$ which are about 1700 bhn and are highly abrasion resistant in a matrix which will self harden to at least 300 bhn and preferably from about 400 to 600 bhn.

Other and further objects, features and advantages of the invention appear throughout.

DESCRIPTION OF PRESENTLY PREFERRED EMBODIMENTS

Figure 1:
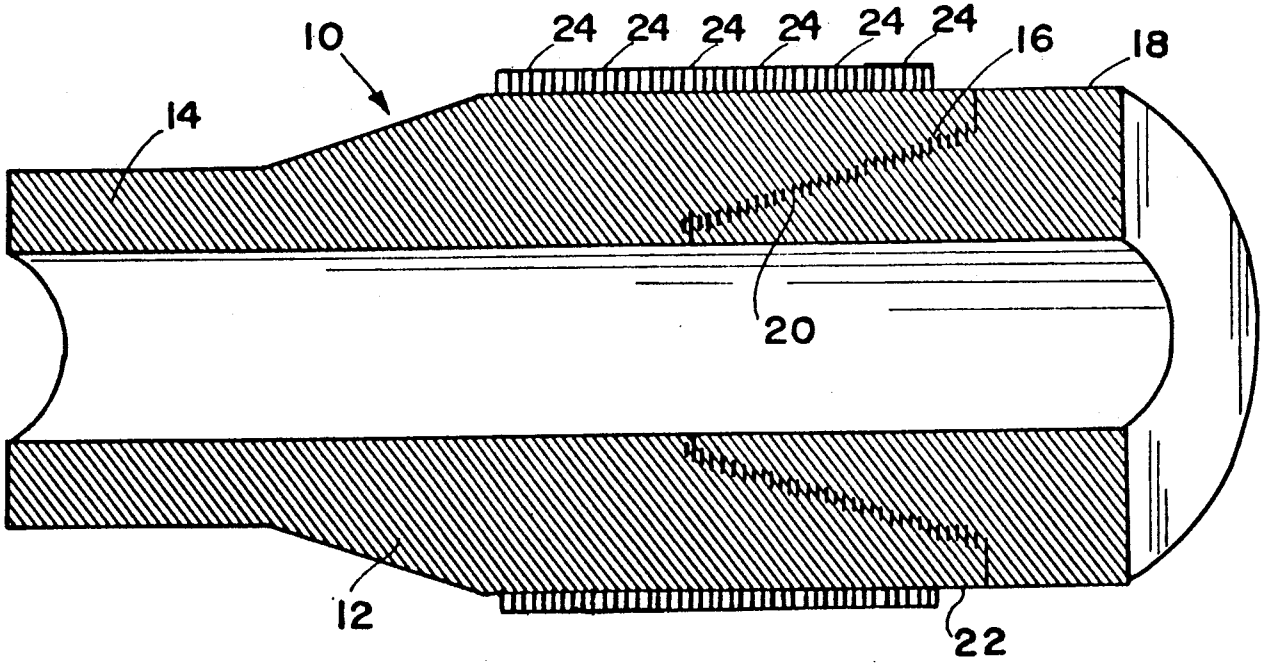
FIG. 1 is a fragmentary longitudinal sectional view of a tool joint hardfaced according to the invention.

Referring now to FIG. 1, a tool joint for drill pipe 10 is illustrated, which has a box 12 at an end of the drilling pipe 14 which is internally threaded at 16 which threadedly receives a pin 18 having coacting threads 20 to the thread 16 so that the pin 18 can be threaded into the box 12. While not shown, the pin 18 forms the end of a drill pipe, such as 14, so that a string or joints of drill pipe can be threadedly secured together and disconnected for drilling oil, gas and other wells.

The box 12 is enlarged and has an outer cylindrical surface 22 having an outer diameter greater than the outer diameter of the drill pipe 14.

To the outer cylindrical surface 22 of the box 12 there is welded a plurality of transversely extending beads 24 of hardfacing material harder than silicious earth materials which upon cooling from a molten stage to ambient temperatures shrinks and forms a plurality of cracks extending transversely through the hardfacing beads 24 generally normal to the cylindrical surface 22 in a generally random and nonlinear pattern of a frequency of less than about 1 in 3 inches and, preferably, the cracks are spaced apart about ½ inch to 1 inch.

Figure 2:
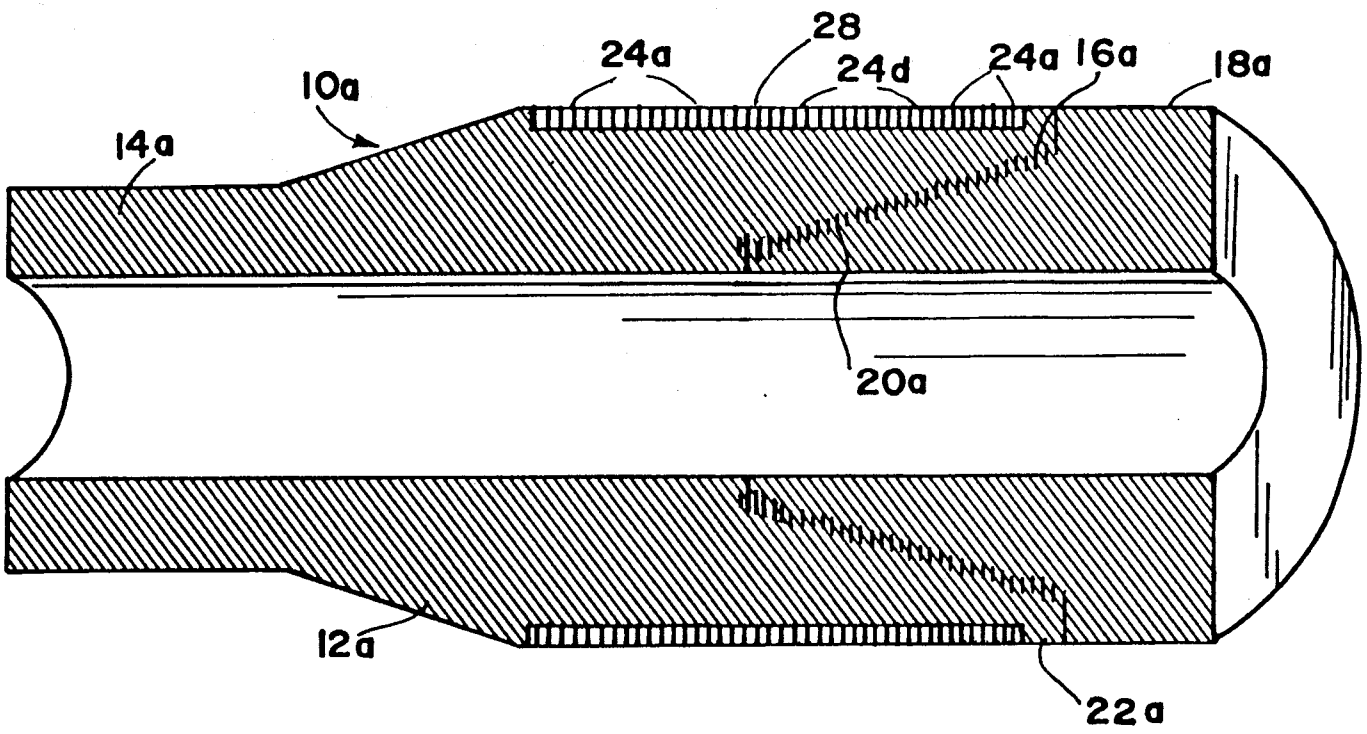
FIG. 2 is a view similar to that of FIG. 1 illustrating a modification of the invention.

Referring now to FIG. 2, where the reference letter "a" have been added to reference numerals corresponding to those in FIG. 1, the tool joint **10*a* of FIG. 2 is identical to that of the tool joint 10 of FIG. 1 except that a circumferential band of material 26 has been either removed from the outer cylindrical surface 22*a* of the box 12*a* or was originally formed with this reduced diameter section and the hardfacing material 28 is welded in this space so that the surface of the weld deposited hardfacing 28*a* is substantially flush with the outer cylindrical surface 22*a* of the box 12*a***.

Normally, the weld beads 24 are about ⅜" thick, and if desired, to have the surface **22*a* of the weld beads 24 substantially flush with the surface of the box about ⅜" of material 22** is removed.

The presently preferred hardfacing material is a mixture of high chrome iron of from about 20 percent to about 30 percent chromium and 3.5 to 5 percent carbon by weight and which self hardens when cooling from molten stage to ambient temperatures to contain about 40% chromium carbides of the $(FeCr)_7C_3$ type.

Any desired abrasion resistant composition harder than silicious earth materials can be used for the hardfacing material which has low to no ductility and low tensile strength or both so that upon cooling from welding the cracks that form will be within the frequency range set forth.

The following are typical compositions of hardfacing material which are satisfactory and which form cracks within the range specified, which are harder than silicious earth materials, and will not act as a cutting surface to casing. In these examples and throughout the application and claims, percentages are by weight.

EXAMPLE 1

| | Percent |
|---|---|
| Chromium | 27 |
| Carbon | 3.5 |
| Balance | Iron |

The composition of Example 1 provides a surface of one of at about ¾]inch intervals in each bead when applied to the metal base plate 10.

EXAMPLE 2

| | Percent |
|---|---|
| Chromium | 33 |
| Carbon | 3.5–4.5 |

-continued

| | Percent |
|---|---|
| Balance | Iron |

The composition of this example also provides a very high abrasion resistant surface and a frequency of cracks within the range specified in each bead applied to the base plate 10.

EXAMPLE 3

| | Percent |
|---|---|
| Chromium | 25-35 |
| Manganese | 0-8 |
| Carbon | 2.5-5 |
| Molybdenum | 0-2 |
| Boron (may be added) | 0-5 |
| Iron | Balance |

EXAMPLE 4

| | Percent |
|---|---|
| Carbon | 4 |
| Silicon | .8 |
| Iron (welded with chill) | Balance |

EXAMPLE 5

| | Percent |
|---|---|
| Chromium | 5 |
| Carbon | 2 |
| Boron | 5 |
| Iron | Balance |

EXAMPLE 6

| | Percent |
|---|---|
| Carbon | 3.5 |
| Chromium | 18 |
| Boron | 4 |
| Nickel | Balance |

In all of Examples 3 through 6, cracks 20 occur within the frequency range specified and the beads 22 applied to the cylindrical surfaces 22 and **22*a* provide a very satisfactory hard surfacing and an abrasion resistant plate, and have a hardness greater than that of silicious earth materials. Also, in all of the foregoing examples, the outer cylindrical surface 22 and 22*a* of the box 12 and 12*a*** provide a satisfactory base for applying the hardfacing beads.

For further examples of satisfactory abrasion resistant material reference is made to U.S. Pat. Nos. 3,402,459; 3,407,478; and 3,494,749.

The method of the invention for prolonging the service life of tool joints connecting drill pipe together comprises deposition welding or bulk welding a layer of the hardfacing material 24 or **24*a* to the outer cylindrical surface 22 or 22*a* of the box 12 or 12*a* of the tool joint box 10 or 10*a*. Preferably, the deposition or bulk welding is by weld beads 24 or 24*a* extending transversely of the longitudinal axis of the box 10** with the hardfacing material described above so that upon cooling from molten condition to ambient temperature the material shrinks to form the hard surface layer with generally transverse cracks, as described above.

In bulk welding, the granular electrically conductive weld particle mix is placed on the surface 22 or **22*a* and an electric welding electrode is moved at a predetermined rate with the arc between the electrode and the upper surface of the weld particle mix for forming the hardfacing alloy with primary carbides welded to the surface 22 or 22*a*** with a minimum of melting of the base metal thereof. For a further description of bulk welding reference is made to U.S. Pat. Nos. 3,062,948; 3,060,307; 3,076,888; 3,264,445; 3,296,408; and 3,513,283.

After long periods in service where abrasion by earth materials may abrade away an area of the hardfacing, additional hardfacing may be applied by deposition or bulk welding without essential damage to the box 10.

As previously mentioned, while it has not been the practice to do, the hardfacing material may be applied to the pin member 18 as well as other places of the tool joint 10, if so desired.

In the 50 year history of hardfacing tool joints, connecting together drilling pipe, no facing which cracked has ever been known to have been used on tool joints in practice prior to the development of the present invention.

The present invention, therefore, is well suited and adapted to attain the objects and ends and has the advantages and features mentioned as well as others inherent therein.

While presently preferred embodiments of the invention have been given for the purposes of disclosure, changes may be made within the spirit of the invention as defined by the scope of the appended claims.

What is claimed is:

1. A tool joint for connecting together drill pipe, the tool joint having an internally threaded box and interconnecting threaded pin, the box having a cylindrical outer surface with an outer diameter greater than the drill pipe's outer surface, including a layer of hardfacing material harder than silicious earth materials welded to the outer cylindrical surface, which hardfacing material contains primary chromium carbides which on cooling to ambient temperature pull apart and form a plurality of cracks extending through the hardfacing material generally normal to the cylindrical surface, the primary chromium carbides being present in a quantity sufficient to form the cracks in a generally random and nonlinear pattern of a frequency of not less than about one in each 3 inches, thereby providing a surface resistance to abrasion wear by silicious materials without substantial damage to the box and to casing through which the drill pipe moves.

2. The tool joint of claim 1 where, the quantity of the primary chromium carbides is sufficient to form the plurality of cracks of a frequency of less than 2 inches apart.

3. The tool joint of claim 1 where the hardfacing material comprises, high chrome iron of from about 20 percent to about 30 percent chromium, about 3.5 percent to about 5 percent carbon, and self hardens on cooling to produce the primary chromium carbides of the formula $(FeCr)_7C_3$ in a matrix which has a hardness at least of 300 bhn.

4. The tool joint of claim 1 wherein, the hardfacing is welded to the outer cylindrical surface in weld beads transversely of the longitudinal axis of the box.

5. A tool joint for connecting together drill pipe, the tool joint having a threaded box and a threaded pin, the box having a cylindrical outer surface with an outer diameter greater than the drill pipe's outer surface, the outer surface of the box having a reduced diameter portion extending along a substantial portion of its length, including a layer of hardfacing material harder than silicious earth materials welded to the outer reduced diameter portion, the hardfacing material containing primary chromium carbides which on cooling to ambient temperature pull apart and form a plurality of cracks extending through the hardfacing material generally normal to the cylindrical surface, the primary chromium carbides being present in a quantity sufficient to form a generally random and nonlinear pattern of cracks of a frequency of not less than about 1 in each 3 inches, thereby providing a surface resistant to abrasion wear by silicious materials without substantial damage to the box and to casing through which the drill pipe moves, the layer of hardfacing material's outer surface being substantially flush with the outer cylindrical surface of the box.

6. The tool joint of claim 5 where the quantity of the primary chromium carbides is sufficient to form cracks of a frequency less than 2 inches apart.

7. The tool joint of claim 5 where the hardfacing material comprises, high chrome iron of from about 20 percent to about 30 percent chromium, about 3.5 percent to about 5 percent carbon, and self hardens on cooling to produce primary chromium carbides of the formula $(FeCr)_7C_3$ in a matrix which has a hardness of at least 300 bhn.

8. The tool joint of claim 5 where, the hardfacing material is welded to the reduced diameter portion in beads transversely of the longitudinal axis of the tool joint.

9. A method of prolonging the life of a tool joint connecting together drill pipe, the tool joint having a connectable threaded box and pin, the box having a cylindrical outer surface with an outer diameter greater than the drill pipe's outer surface comprising, welding a layer of hard surfacing material containing chromium, carbon and iron to the outer cylindrical surface of the box, the hardfacing material on cooling from molten state to solid state forming primary chromium carbides harder than silicious earth materials which pull apart and form cracks extending through the hard surface generally normal to the cylindrical surface in a generally random and nonlinear pattern, the primary chromium carbides being present in sufficient quantity to form the cracks in a frequency of not less than about one in each 3 inches.

10. The method of claim 9 where, the quantity of the primary chromium carbides formed on cooling is sufficient to form cracks of a frequency of less than about 2 inches apart.

11. The method of claim 9 where the hard surfacing material comprises high chrome iron of from about 20 percent to about 30 percent chromium, about 3.5 percent to about 5 percent carbon, and self hardens on cooling to produce the primary chromium carbides of the formula $(FeCr)_7C_3$ in a matrix of at least 300 bhn.

12. The method of claim 9 comprising, welding the hard surfacing material to the outer cylindrical surface in side by side beads extending transversely of the longitudinal axis of the box.

13. The method of claim 12 comprising, the hard surfacing material to the cylindrical surface while melting the cylindrical surface to a bonding minimum.

* * * * *